United States Patent [19]

Moss

[11] Patent Number: 4,532,737

[45] Date of Patent: Aug. 6, 1985

[54] METHOD FOR LAPPING DIAMOND

[75] Inventor: Herbert I. Moss, Yardley, Pa.

[73] Assignee: RCA Corporation, Princeton, N.J.

[21] Appl. No.: 450,197

[22] Filed: Dec. 16, 1982

[51] Int. Cl.[3] ..... B24B 1/00; B24D 3/34

[52] U.S. Cl. ..... 51/283 R; 51/DIG. 6; 51/308; 125/30 R

[58] Field of Search ..... 51/283, 209 R, 209 DL, 51/295, 297, 309, 308, 293, DIG. 6; 125/30 R

[56] References Cited

U.S. PATENT DOCUMENTS

| | | | |
|---|---|---|---|
| 3,661,570 | 5/1972 | Moss | 75/206 |
| 3,676,610 | 7/1972 | Moss et al. | 179/100.2 C |
| 3,739,445 | 6/1973 | Gabriel et al. | 29/182 |
| 3,814,598 | 6/1974 | Gabriel et al. . | |
| 4,029,501 | 6/1977 | Moss | 75/206 |
| 4,162,510 | 7/1979 | Keizer | 358/128 |
| 4,321,772 | 3/1982 | Ziegel | 51/109 |
| 4,369,604 | 1/1983 | Kaganowicz | 51/281 R |
| 4,428,165 | 1/1984 | Dholakia | 51/283 R |

OTHER PUBLICATIONS

E. M. Wilks et al., "The Resistance of Diamond to Abrasion", J. Phys. D:Appl. Phys., vol. 5, 1972, pp. 1902–1919.

"Flat Lapping with Diamond Abrasive—Using the Proper Lap Plate," *Cutting Tool Engineering,* May/Jun. 1981, pp. 77–78, by Don Hurst.

*Primary Examiner*—Frederick R. Schmidt

*Assistant Examiner*—Robert Rose

*Attorney, Agent, or Firm*—Birgit E. Morris; Theodore R. Furman

[57] ABSTRACT

An improved method for lapping the facets on a hard material such as a diamond provides faster machining and reduced crystallographic sensitivity. The improved method uses a lapping disc coated with an abrasive slurry, which lapping disc comprises a ternary alloy of aluminum, silicon and iron, and which alloy may be oxidized for even further enhanced lapping of the diamond.

10 Claims, No Drawings

METHOD FOR LAPPING DIAMOND

This invention relates to an improved method for lapping a diamond. More particularly, the invention is concerned with a method which employs a lapping disc with an improved work surface.

BACKGROUND OF THE INVENTION

The miniaturization of diamond parts, such as playback styli, has increased the need for reproducible, accurate machining of diamond parts to the micron and submicron levels. For example, U.S. Pat. No. 4,162,510 to Keizer discloses a diamond stylus for a high density information record playback system such as a video disc player, which is shaped so as to have a tip portion of only about 2 microns by 2 microns.

To form a stylus of the type disclosed by Keizer two facets are initially formed near the tip of a crystallographically oriented diamond bar to form a tip or prow on the diamond bar. The facets have heretofore been machined by a method which includes the use of a lapping apparatus such as that described in U.S. Pat. No. 4,321,772 to Ziegel. Such a lapping apparatus typically includes a high speed motor attached by a drive shaft to a drive plate on which a lapping disc is mounted. Typically, the lapping disc is made of a porous tool-steel disc which in use is coated with an abrasive slurry. The porous tool-steel disc serves as a rigid support to hold the abrasive slurry in place during lapping of a diamond article. A typical abrasive slurry comprises 0.1 micrometer diamond particles in oil. A diamond bar held in direct contact with the diamond-abrasive coated work surface of the rotating lapping disc can be lapped to various desired shapes and/or sizes. This prior art process takes a considerable amount of time, however, due to the extreme hardness of diamond.

It would be desirable to have an improved lapping method which could increase the rate of lapping. Also, since diamond exhibits directional variations in hardness due to the crystallographic structure a lapping method which is less sensitive to this directional hardness and which would provide a net decrease in machining time per facet would also be highly desirable.

SUMMARY OF THE INVENTION

An improved lapping disc and method is disclosed wherein the lapping disc has a work surface made of a ternary alloy of aluminum, silicon and iron which, when coated with an abrasive slurry exhibits substantially increased faceting rates during machining of diamonds and, in addition, provides enhanced uniformity in the rate of machining facets of differing crystallographic orientation. Especially good results are obtained when the ternary alloy is oxidized in that even better machining rates are provided.

DETAILED DESCRIPTION OF THE INVENTION

Ternary alloys of aluminum, silicon, and iron are known in the art and have heretofore been suggested for use in the manufacture of wear-resistant magnetic record-playback heads used with magnetic tape systems in video recorders. It has now been found that the ternary alloys comprised of about 2–20% by weight of silicon, about 2–20% by weight of aluminum and the balance iron, and preferably comprised of about 9.4% by weight silicon, about 5.7% by weight of aluminum and the balance iron, are especially useful when formed into discs for lapping diamond. The excellent machining capabilities of the ternary alloys, when formed into a lapping disc for use in shaping hard materials such as diamond, in accordance with the present invention, were not recognized up until now. Further, the improved disc and method of the present invention surprisingly shows reduced sensitivity or variability in machining rate along various crystallographic planes of an oriented diamond bar. The faster faceting rates and enhanced uniformity of lapping rates from one facet to another was unexpected and have given the improved disc and method of the present invention a decided advantage over the prior art faceting methods.

The method of the present invention can be even further improved by employing a lapping disc made from oxidized ternary alloys of aluminum, silicon and iron in that oxidized alloys provide even better lapping properties than unoxidized alloys. Further, the present invention has surprisingly shown excellent improvements in grinding diamond, even when the ternary alloy lapping material is densified to about 99.9% of its theoretical density. Although it is not known how this virtually pore-free material holds the abrasive slurry in place during grinding, it is thought that the grain boundaries of the alloy support the slurry. When the lapping article is fabricated from an oxidized version of the ternary alloy, the oxide appears in the grain boundaries. It is believed that this oxide within the grain boundaries further enhances the rigid supporting and holding of the abrasive slurry, and may also act as a secondary abrasive.

The lapping disc of the present invention can be made by convenient methods known in the art. The ternary alloy can be vacuum cast or hot-pressed into a lapping article in an unoxidized state or, preferably, can be fabricated from an oxidized powder of the ternary alloy. In one such method, the ternary alloy is ground to a particle size of less than 44 microns, and preferably less than 20 microns. Particularly suitable alloys which are commercially available comprise about 5.7% by weight of aluminum, about 9.4% by weight of silicon and the balance substantially iron. The finely divided particles are uniaxially vacuum hot pressed to the desired disc shape for about 1 hour at 950°–1100° C., at a pressure of about 15,000 psi. Hot pressing in an inert gas such as argon, or hot isostatic pressing would also be suitable. The pressed disc is machined flat on both sides and the work surface of this lapping disc can be charged with a slurry of diamond particles in oil as are the lapping discs of the prior art.

A preferred method of the present invention uses a lapping disc made of an oxidized ternary alloy of aluminum silicon and iron. As mentioned above, suitable ternary alloys are commercially available. A method for making an oxidized ternary alloy is described by Moss in U.S. Pat. No. 4,029,501. As disclosed by Moss, a ternary alloy is reduced to a particle size of less than 44 microns and, preferably, less than about 20 microns. A basic aqueous solution is prepared from any strong inorganic base, such as sodium hydroxide, potassium hydroxide, or the like, and heated to an elevated temperature, suitably from about 45° C. up to the boiling point of the solution. A small amount of alkali metal chlorate is then added. The finely-divided alloy particles are then rapidly stirred into the solution to form a thin oxide layer around each particle. The amount of oxide formed will depend on the temperature of the basic solution, the amount of alkali metal chlorate present and the time of oxidation. The final product should contain from about 2000 up to about 20,000 parts per million of oxygen, preferably about 9500 parts per million of oxygen. The oxidized particles are then rapidly cooled to stop the oxidation reaction, separated from the solution, washed thoroughly to remove the base and chlorate and then dried.

The dried oxidized ternary alloy particles are densified to the desired disc shape by means of uniaxial vacuum hot pressing as described above. The pressed disc is machined flat on both sides and the work surface of the lapping disc is coated with a slurry of diamond particles in oil.

The present invention will be further described by the following Examples, however, it is to be understood that the invention is not meant to be limited by the details described therein.

EXAMPLE I

A suitable process for fabricating a lapping disc whose work surface comprises such a ternary alloy of aluminum, silicon and iron is described herein. A ternary alloy comprising about 5.7% by weight of aluminum, 9.4% by weight of silicon and about 84.9% by weight of iron, was milled to have a particle size of less than 44 microns. The finely divided particles were loaded into a disc-shaped die and vacuum hot pressed up to 1040°–1060° C. while increasing the pressure to about 15,000 psi and maintaining these conditions for about one hour. The pressure was released and the densified product cooled to room temperature. The disc was machined flat on both sides, rotatably mounted on a lapping machine, and identified as Lapping Disc I.

EXAMPLE II

This example shows a method for making a lapping disc from an oxidized ternary alloy of aluminum, silicon and iron.

A vessel was charged with 900 parts of distilled water and 0.22 mol of sodium hydroxide and heated to about 85° C. While stirring, 0.084 mol of sodium chlorate was added and the temperature stablized at 85° C. 220 parts of an alloy of 84.9% iron, 9.4% silicon and 5.7% aluminum having a particle size less than 20 microns, was added quickly and stirred rapidly for 2 minutes when 1000 parts of cold water was added to halt the oxidation. The solution was decanted off, the oxidized powder washed several times with water, then twice with isopropanol and dried under vacuum at about 70° C.

The oxidized particles were then pressed into a disc shape by heating in a suitable die in a vacuum hot press up to 1040°–1060° C. while increasing the pressure to about 15,000 psi and maintaining these conditions for one hour. The pressure was released and the densified product cooled to room temperature. The oxygen content was 4500 part per million. This disc was designated Lapping Disc II and was machined flat on both sides, and rotatably mounted on a lapping machine.

EXAMPLE III

In this Example, Lapping Disc III was formed by the method of Example II except that the oxidation treatment was for 5 minutes instead of 2 minutes. The resultant disc contained about 9500 parts per million of oxygen and was machined flat on both sides and rotatably mounted on a lapping apparatus.

EXAMPLE IV

In this Example, the lapping discs of Examples I, II, and III were used to facet diamond bars for use as video disc styli. Further, the grinding characteristics of the lapping discs were compared to a prior art, tool-steel lapping disc identifed as Control Lapping Disc. All four discs were rotatably mounted on a lapping apparatus, coated with an abrasive slurry comprising 0.1 micrometer diamond particles in oil, and rotated at a linear velocity of 15 meter per second to machine a first and second facet on a group of diamond bars for use as video disc styli. The Control Lapping Disc and Lapping Disc I were used to facet 15 bars each, Lapping Disc II was used to facet 30 bars, and Lapping Disc III was used to facet 25 bars. The averaged results are summarized below in Table I.

TABLE I

| | Grinding Time (minutes/facet) | |
|---|---|---|
| | 1st Facet | 2nd Facet |
| Control Lapping Disc | 41.3 | 88.1 |
| Lapping Disc I (unoxidized) | 31.5 | 31.2 |
| Lapping Disc II (4500 ppm oxygen) | 19.1 | 20.2 |
| Lapping Disc III (9500 ppm oxygen) | 13.1 | 13.6 |

What is claimed is:

1. In a method for lapping a diamond which comprises coating a lapping disc with an abrasive slurry, positioning the diamond to be lapped in direct contact with the work surface of the lapping disc, and establishing relative motion between the disc and the diamond; the improvement which comprises:

employing a lapping disc whose work surface is fabricated from a ternary alloy comprising from about 2–20% by weight of aluminum, about 2–20% by weight of silicon and the balance iron.

2. The lapping method according to claim 1 wherein the ternary alloy comprises about 5.7% by weight of aluminum, about 9.4% by weight of silicon and the balance iron.

3. The lapping method according to claim 1 wherein the work surface of the lapping disc is fabricated from an oxidized ternary alloy which contains from about 2,000 to about 20,000 parts per million of oxygen.

4. The lapping method according to claim 3 wherein the alloy contains about 9,500 parts per million of oxygen.

5. A lapping disc for lapping a diamond comprising a disc having a work surface thereon, which work surface is coated with an abrasive slurry, wherein the work surface of the disc comprises a ternary alloy of about 2–20% by weight of aluminum, about 2–20% by weight of silicon and the balance iron.

6. The lapping disc according to claim 5 wherein the ternary alloy comprises about 5.7% by weight of aluminum, about 9.4% by weight of silicon and the balance iron.

7. The lapping disc according to claim 5 wherein the ternary alloy of aluminum, silicon and iron contains from about 2,000 to about 20,000 parts per million of oxygen.

8. The lapping disc according to claim 7 wherein the ternary alloy of aluminum, silicon and iron contains about 9,500 parts per million of oxygen.

9. The method of claim 1 wherein the work surface of the ternary alloy is substantially pore-free.

10. The lapping disc of claim 5 wherein the work surface of the ternary alloy is substantially pore-free.

* * * * *